United States Patent [19]

Musgrave

[11] 4,108,070

[45] * Aug. 22, 1978

[54] EXPLOSIVE OBSTACLE WIRE

[76] Inventor: Daniel Dennis Musgrave, 8201 Caraway St., Cabin John, Md. 20731

[ * ] Notice: The portion of the term of this patent subsequent to Apr. 5, 1994, has been disclaimed.

[21] Appl. No.: 817,196

[22] Filed: Jul. 20, 1977

Related U.S. Application Data

[63] Continuation-in-part of Ser. No. 757,201, Jan. 6, 1977, which is a continuation-in-part of Ser. No. 676,067, Apr. 12, 1976, Pat. No. 4,015,506.

[51] Int. Cl.[2] ..... F42B 23/00; E04H 17/04

[52] U.S. Cl. ..... 102/8; 102/27 R; 102/67; 256/6; 256/8

[58] Field of Search ..... 102/8, 27 R, 67; 89/1 A, 1 B; 256/6, 8

[56] References Cited

U.S. PATENT DOCUMENTS

| | | | |
|---|---|---|---|
| 2,812,710 | 11/1957 | Tyson | 102/8 |
| 3,698,280 | 10/1972 | Welsh | 86/1 R |
| 3,731,626 | 5/1973 | Grayson | 102/27 R |
| 3,763,529 | 10/1973 | Musgrave | 256/8 |
| 3,971,290 | 7/1976 | Blair | 89/1 B |
| 4,015,506 | 4/1977 | Musgrave | 89/1 A |

*Primary Examiner*—Edward A. Miller

[57] ABSTRACT

An explosive obstacle wire for rapid emplacement with bare hands. The wire is assembled in a configuration wherein barbs or other hazardous elements are ineffective. After installation in an obstacle the barbs can be quickly deformed into a hazardous configuration by explosive means. This abstract is prepared to facilitate searching and it should not be construed as a limitation of the invention.

14 Claims, 11 Drawing Figures

EXPLOSIVE OBSTACLE WIRE

This application is a continuation-in-part of my copending application No. 757,201 filed Jan. 6, 1977 and entitled Explosive Barrier Wire which is in turn a continuation-in-part of Ser. No. 676,067 filed Apr. 12, 1976 and now U.S. Pat. No. 4,015,506.

This invention relates to an explosive obstacle wire for use in barricades or obstacles, such as those employed in military operations. The typical obstacle materials employed for such purposes require the use of tools or gloves during installation. Even when tools or gloves are used, installation is sometimes impracticable, as for example in darkness, in fog, or underwater by swimmers.

There are also situations requiring the installation of an obstacle in the absolute minimum of time. It is readily apparent that obstacle material which can be handled safely can be installed faster than that which is dangerous to handle.

In consideration of the above-recited circumstances the principal object of this invention is to provide an explosive obstacle wire which can remain relatively safe until installed in an obstacle, after which it can be rendered dangerous to handle or traverse.

It is also an object of this invention to provide an obstacle wire having hazardous elements of maximum effectiveness, yet adapted for convenient transportation without tangling.

These and other objects of the present invention will become apparent from the following detailed specification, taken in conjunction with the accompanying drawings, wherein.

The several views have been selected merely for convenience in disclosure of the invention, and they should not be construed as limitations. In actual practice, variations of geometry, materials, or other features might be incorporated, within the scope of this invention.

Figure 1:
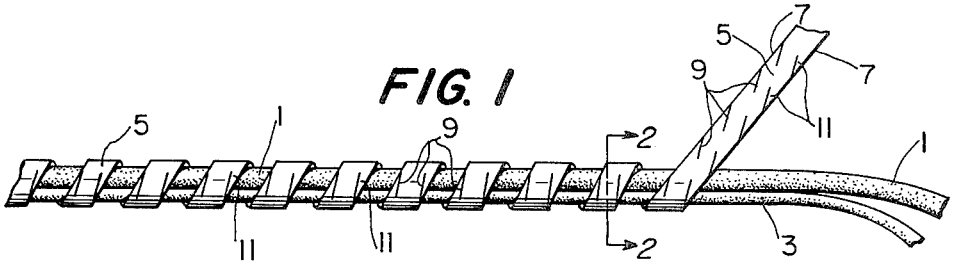
FIG. 1 shows an arrangement for assembling the component parts of an explosive obstacle wire.

Referring to the drawings FIG. 1 shows an obstacle wire comprising an explosive cord 1, a supporting strand 3, and a deformable strip 5 wrapped helically around the cord and the strand. Along its edges 7 strip 5 has grooves 9 which intersect said edges at acute angles thus defining a series of pointed portions 11.

Figure 4:
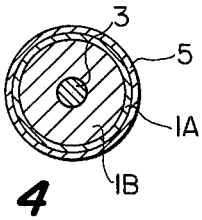
FIG. 4 shows an alternate arrangement of the component parts of an explosive obstacle wire.
Figure 2:
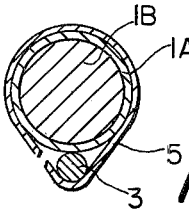
FIG. 2 is a cross-section taken in the plane indicated by line 2—2 on FIG. 1.

As may be seen in FIG. 2, cord 1 comprises a jacket 1A and an explosive core 1B. In FIG. 2 the cord and the strand are positioned side-by-side. It is also possible to position the strand centrally within the explosive core as shown in FIG. 4. With either arrangement the deformable strip is wrapped around the outside.

Figure 3:
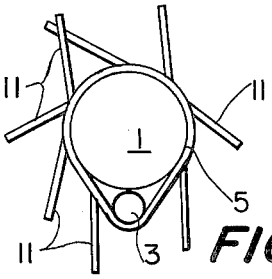
FIG. 3 is a schematic representation of the same plane 2—2 after the obstacle wire has been exploded into a hazardous configuration.

FIG. 3, which is schematic, shows the relationship of the several components after the explosive cord has been exploded. In this Figure the numeral 1 indicates the location of the cord before the explosion occurs. The explosion has caused grooves 9 to become slits, which permits pointed portions 11 to deform out from the strip. It is desired to emphasize that the illustrations are for purpose of disclosure and that the appearance of a deformed strip may vary considerably depending on its composition, its geometry and the nature of the explosive used in the cord. To avoid rupturing the strip, holes may be formed therein at intervals, thus relieving the explosive thrust somewhat.

Figure 5:
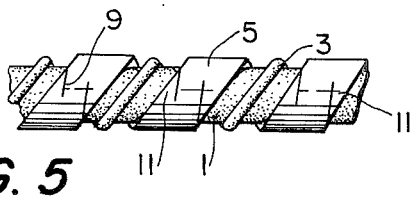
FIG. 5 shows another alternate arrangement of said parts.

In FIG. 5, deformable strip 5 is wrapped helically around explosive cord 1, and supporting strand 3 is also wrapped helically around the cord. The two helixes are substantially parallel. When the cord is exploded the pointed portions are bent out as described for FIG. 3. To some extent, the points will then entangle with strand 3.

Figure 6:
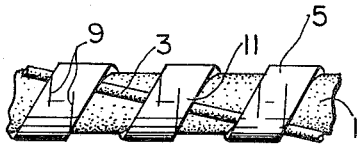
FIG. 6 shows a different alternate arrangement of said parts.
Figure 7:
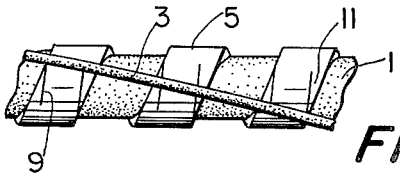
FIG. 7 shows another possible arrangement of said parts.

In FIG. 6, strip 5 is wrapped helically around explosive cord 1. Strand 3 is also wrapped helically around the cord, but the two helixes are revolved oppositely, and as a result, the strand and the strip intersect at an angle. In FIG. 6 the strand is wound on the cord under the strip. FIG. 7 differs from FIG. 6 only in that the strand is wound over the strip.

Figure 8:
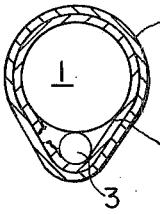
FIG. 8 is a cross-section similar to FIG. 2 but disclosing an additional optional component.

FIG. 8 shows a section similar to FIG. 2, but a cover 13 has been wrapped around the assembled obstacle wire to protect it. The cover can be of any suitable material. When the cord is exploded the cover will be ruptured, and the points will be exposed.

Figure 9:
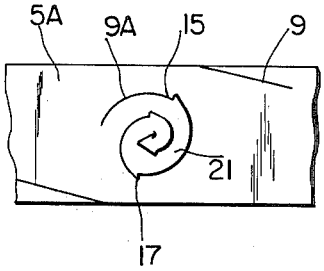
FIG. 9 is a view of a piece of deformable obstacle material.
Figure 10:
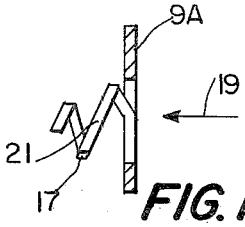
FIG. 10 is a schematic representation of the material shown in FIG. 9, disclosing how it can be deformed.

FIG. 9 shows a strip 5A having grooves 9 as described above, and also having a spiral groove 9A. Groove 9A includes offset portions 15 which define barbs 17. The operation of forming the barbs is shown schematically in FIG. 10. The tape being positioned to receive an explosive thrust indicated by arrow 19, groove 9A splits and permits helical portion 21 to be projected out from the tape. Of course, the explosive thrust could be provided by wrapping the tape around an explosive cord, and exploding the cord.

When helical portion 21 is thus projected barbs 17 will be exposed for maximum effect. The utility of this projected helical barbed portion is not limited to the type of explosive obstacle wire described herein. It can be employed in various other obstacle devices.

Figure 11:
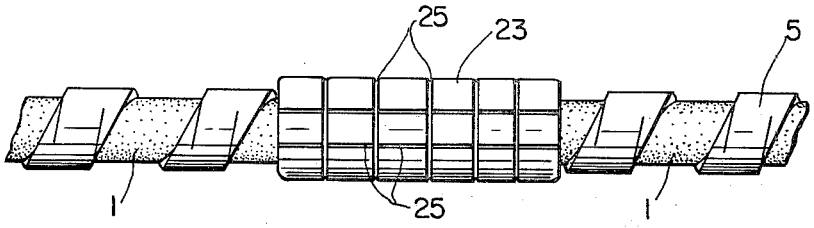
FIG. 11 shows a portion of an explosive obstacle wire including an additional optional component.

In FIG. 11 there is shown an obstacle wire comprising an explosive cord 1 and a deformable strip 5 wrapped helically around it. The obstacle wire might be any of those described above, but for convenience that shown in FIG. 4 is illustrated. Encompassing the assembled obstacle wire is a frangible jacket 23 of any suitable material, such as cast iron. This jacket has serrations 25 which can permit it to burst into a large number of fragments when the cord is exploded.

When the explosive obstacle wire has been installed in a barrier without exploding, and frangible jackets 23 are placed thereon, persons approaching the barrier will be apprehensive of the possibility of the wire exploding and fragmenting jacket 23. The explosion could be controlled for example, by a sensor and suitable explosive initiating means. This will deter intruders from approching the unexploded barrier.

It is readily apparent that dummy frangible jackets could also be used, to deceive intruders. These could be made of some light weight, bulky material such as balsa wood, which would have negligible ballistic effect. They would obviously be safer to handle, yet they would have some deterrent capability.

There is thus disclosed an explosive obstacle wire of simple construction, using readily available components. It is desired to emphasize that the disclosure is exemplary of the invention and that it should not be considered limiting. This is particularly true of the deformable strip which could be provided with a variety of patterns of grooves or slits, other than those shown. Furthermore, no limitation is intended upon the type of obstacle, barrier, or entanglements, in which this invention may be used.

What I claim is:

1. An explosive obstacle wire comprising: an explosive cord; a strip wrapped around said cord, said strip including portions adapted for deformation outwardly to a hazardous configuration; and a strand positionally adapted for supporting said cord and said strip; whereby initiation of said cord can deform said portions outwardly to said hazardous configuration.

2. An explosive obstacle wire as set forth in claim 1 wherein said strand is disposed substantially parallel to said cord.

3. An explosive obstacle wire as set forth in claim 1 wherein said strand is disposed within said cord.

4. An explosive obstacle wire as set forth in claim 1 wherein said strip is wrapped helically around said cord.

5. An explosive obstacle wire as set forth in claim 1 wherein said strand is wrapped helically around said cord.

6. An explosive obstacle wire as set forth in claim 4 wherein said strand is wrapped helically around said cord, said strip and said strand being substantially parallel.

7. An explosive obstacle wire as set forth in claim 4 wherein said strand is wrapped helically around said cord with said strip and said strand intersecting at an angle.

8. An explosive obstacle wire as set forth in claim 4 wherein said strand is wrapped helically around said cord with said strip and said strand intersecting at an angle and with said strand being in continuous contact with said cord.

9. An explosive obstacle wire as set forth in claim 4 wherein said strand is wrapped helically around said cord with said strip and said strand intersecting at an angle and with said strip being in continuous contact with said cord.

10. An explosive obstacle wire as set forth in claim 1 further provided with external cover means positionally adapted to be ruptured by said portions when said portions are deformed outwardly to said hazardous configuration.

11. An explosive obstacle wire as set forth in claim 1 further provided with a frangible jacket encompassing said wire and adapted to fragment when said cord is initiated.

12. An explosive obstacle wire as set forth in claim 11 wherein said jacket is comprised of material of low density.

13. An obstacle material comprising: a piece of deformable material having at least one substantially flat surface; and a generally spiral groove formed in said surface, said groove including offset portions defining barbs; whereby a force acting substantially perpendicularly against said surface can split said groove and deformably project a portion defined by said groove out from said material.

14. An obstacle material as set forth in claim 13 further provided with explosive means positionally adapted to exert said force against said surface.

* * * * *